United States Patent [19]

Matsuda

[11] 4,418,280

[45] Nov. 29, 1983

[54] DOUBLE FOCUSING MASS SPECTROMETER

[75] Inventor: Hisashi Matsuda, Takarazukashi, Japan

[73] Assignee: Jeol Ltd., Tokyo, Japan

[21] Appl. No.: 270,845

[22] Filed: Jun. 5, 1981

[30] Foreign Application Priority Data

Jun. 13, 1980 [JP] Japan ..... 55-79699

[51] Int. Cl.[3] ..... D01D 59/44

[52] U.S. Cl. ..... 250/296; 250/298

[58] Field of Search ..... 250/296, 297, 282, 281, 250/396 R, 396 ML, 305

[56] References Cited

U.S. PATENT DOCUMENTS

| | | | |
|---|---|---|---|
| 3,061,720 | 10/1962 | Ewald | 250/296 |
| 3,202,817 | 8/1965 | Belbeoch | 250/396 ML |
| 3,920,988 | 11/1975 | Taya et al. | 250/296 |
| 3,944,827 | 3/1976 | Matsuda | 250/298 |

FOREIGN PATENT DOCUMENTS

| | | | |
|---|---|---|---|
| 2440138 | 3/1975 | Fed. Rep. of Germany | 250/296 |
| 41-12720 | 12/1966 | Japan | 250/296 |

*Primary Examiner*—Bruce C. Anderson

*Attorney, Agent, or Firm*—Webb, Burden, Robinson & Webb

[57] ABSTRACT

A double focusing mass spectrometer having a diverging electrostatic field, a converging electrostatic field and a converging magnetic field. The two electrostatic fields are connected with each other without substantial free space therebetween. The ion beam passes through the electrostatic fields coming to an intermediate focus point adjacent to the ion exit boundary of said converging electrostatic field. The beam then passes through the magnetic field to satisfy the double focusing condition in combination with the electrostatic field. Very small image magnification and aberration free focusing are obtained by this mass spectrometer.

7 Claims, 5 Drawing Figures

DOUBLE FOCUSING MASS SPECTROMETER

BACKGROUND OF THE INVENTION

Mass spectrometers have been widely used for analyzing organic compounds. In recent years, analysis of compounds having molecular weights in the order of several thousands have been attempted by the use of the mass spectrometer. For the analyses in such high mass range, it is essential that the mass spectometer has sufficiently high sensitivity and resolution.

Ordinarily, the resolving power R of a magnetic sector type mass spectrometer is expressed as follows:

$$R = \frac{\gamma \cdot r_m}{X \cdot S + \Delta + d} \quad (1)$$

where S and d represent width of slits for an ion source and a detector, $r_m$ represents a radius of curvature of ion orbit in the magnetic field, $\gamma$ represents a mass dispersion coefficient, X represents image magnification rate, and $\Delta$ represents image expansion due to aberrations. It is apparent from the Eqn. (1) that high resolution can be obtained when the numerator is large and the denominator is small. However, if it is attempted to reduce S for reducing the denominator, the amount of ions capable of drawing out of the ion source is reduced causing a reduction in the sensitivity. For this reason, a high resolution ion optical system can be realized by two methods, one increasing the mass dispersion coefficient $\gamma$, and the other reducing the image magnification rate X. In either case, the aberrations must be of course reduced, and an efficient detection can be realized by selecting the slit width d to be equal to $X \cdot S + \Delta$.

As for the first method, a mass spectrometer having a maximum resolution of 1 million has been produced by combining a uniform magnetic field and a nonconverging magnetic field. This kind of mass spectrometer, however, cannot have a high scanning speed because the two kinds of magnetic fields must be scanned correlatively. For this reason, this kind of mass spectrometer is adapted only for special use, and it can be concluded that a mass spectrometer utilizing a single uniform magnetic field is far advantageous for the practical use which needs a high scanning speed over a wide mass range. In an optical system utilizing a single uniform magnetic field, however, the value of $\gamma$ cannot be much increased, ordinarily being restricted in a range of approximately from 0.5 to 1.0.

From the viewpoint of the above described, a virtual image type double focusing mass spectrometer wherein the image magnification rate X can be reduced by the use of a diverging electrostatic field has been worked out, and used practically. In such a kind of mass spectrometer, a virtual image of the ion source slit is formed by the diverging electrostatic field acting as a concave lens, and ions seemingly emitted from the virtual image are introduced into the uniform magnetic field. By forming the virtual image, the image magnification X can be reduced approximately to $\frac{1}{4}$, and the resolution can be improved corresponding thereto.

However, it is not practical to reduce the image magnification X smaller than $\frac{1}{4}$ by merely enforcing the concave lens action of the diverging electrostatic field in order to improve the resolution because the aberrations abruptly increase with the intensity of the concave lens actions. Therefore, the above described value of the image magnification X is considered to be a lower limit. Several reasons can be given for the increase in the aberrations. The most significant is the effect of the exit boundary of the electrostatic field. More specifically, ions introduced into the diverging electrostatic field are expanded under the concave lens action of the field in the direction of the radius of curvature r, and the degree of expansion increases in accordance with increase in the concave lens action of the field. On the other hand, the disturbance of the field at the exit boundary of the electrostatic field increases with the distance from the central orbit of ions in a direction perpendicular to the electrodes for producing the electrostatic field, that is, in the direction of the radius of curvature r. Accordingly, when it is desired to reduce the image magnification X by increasing the concave lens action, the expansion of the ion beam in the direction of the radius of curvature r increases, thus causing an abrupt increase of the aberrations by the disturbance in the exit boundary of the electrostatic field.

BRIEF DESCRIPTION OF THE INVENTION

In the present invention, a toroidal converging electrostatic field is arranged behind the toroidal diverging electrostatic field without substantial free space therebetween, and an intermediate focus point is formed by the convex lens action of the converging electrostatic field at a position adjacent to the exit boundary of the converging electrostatic field. The beam is then passed through a magnetic field to satisfy the double focusing condition in combination with the electrostatic fields. By minimizing the expansion of the ion beam passing through the exit boundary of the convering electrostatic field, the aberration can be reduced and the image magnification can be reduced in a range of approximately from $\frac{1}{8}$ to 1/10.

It is an advantage according to this invention to avoid the unfavorable effect of the disturbance of the electrostatic field at the exit boundary by reducing the width in the direction of the radius of curvature r of the ion beam passing through the boundary portion.

BRIEF DESCRIPTION OF THE DRAWINGS

FIG. 2(*b*) is a II–II′ cross-sectional view of FIG. 1;

DETAILED DESCRIPTION OF THE INVENTION

Figure 1:
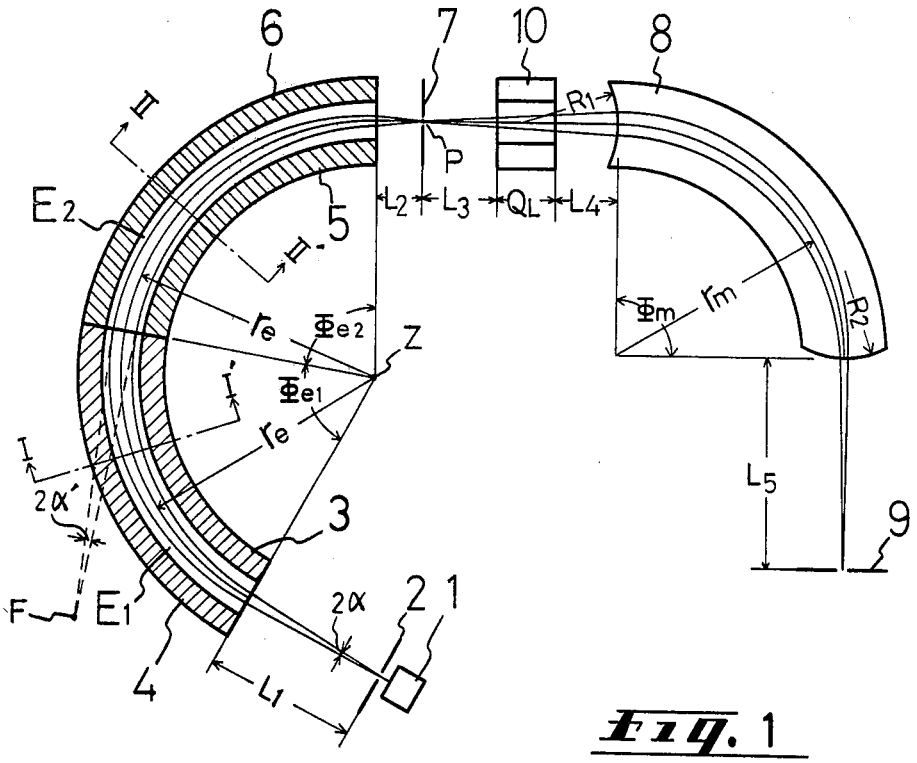
FIG. 1 is a diagram of an embodiment of the invention.

FIG. 1 shows a construction of a double focusing ion optical system in accordance with the present invention. In the figure, an ion source 1 is followed by a main slit 2. An ion beam passing through the main slit 2 is focused at a point P after travelling through a toroidal diverging electrostatic field $E_1$ formed between electrodes 3 and 4 and a toroidal converging electrostatic field $E_2$ formed between electrodes 5 and 6. The ion beam passed through an intermediate slit 7 arranged at the focus point P is introduced into a sector type uniform magnetic field 8 disposed to satisfy a double focusing condition in combination with the electrostatic fields $E_1$ and $E_2$ so that the ion beam is thereby focused at a position where a collector slit 9 is provided. A quadrupole lens 10 is disposed between the intermediate slit 7 and the uniform magnetic field 8 in order to converge the ion beam in a direction perpendicular to the surface of the figure (Z direction).

Figure 2A:
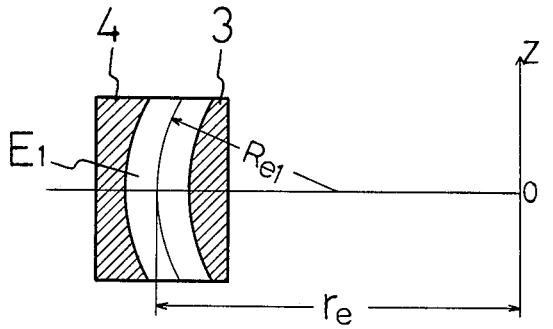
FIG. 2(*a*) is a I–I′ cross-sectional view of FIG. 1.
Figure 2B:
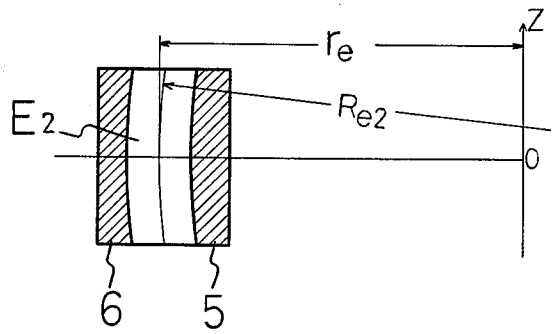

FIGS. 2(*a*) and 2(*b*) are cross-sectional views taken along the lines I–I′ and II–II′ in FIG. 1. In these figures, the radii of curvature of the central orbit of ions in the two electrostatic fields $E_1$ and $E_2$ are made equal to $r_e$. Furthermore, the distance between the electrodes 3 and 4 is equal to the distance between the electrodes 5 and 6, and the inner electrodes 3 and 5 as well as the outer electrodes 4 and 6 are combined in a tight fit manner and are electrically connected together. Accordingly, the electrostatic fields $E_1$ and $E_2$ formed between the inner electrodes 3 and 5 and the outer electrodes 4 and 6 are equal between each other with respect to their field intensities.

On the other hand, the radii of curvature $R_{e1}$ and $R_{e2}$ of equipotential lines passing through the central orbits of ion beams in the electrostatic fields $E_1$ and $E_2$ are made different from each other ($R_{e1}<R_{e2}$) by differentiating the radii of curvature of the electrodes for producing the electrostatic fields $E_1$ and $E_2$. By so doing, constants $C_1$ ($=r_e/R_{e1}$) and $C_2$ ($=r_e/R_{e2}$) of the electrostatic fields $E_1$ and $E_2$ are so selected that conditions $C_1>2$ and $C_2<2$ are satisfied. The constant C defines a property of the electrostatic field, and when $C=0$ the electrostatic field is cylindrical, and when $C>0$, the electrostatic field is toroidal. Particularly when $C>2$, the electrostatic field becomes a diverging field having a concave lens action, and when $C<2$, the electrostatic field becomes a converging field having a convex lens action. In the shown embodiment, the electrostatic field $E_1$ is a diverging field, while the electrostatic field $E_2$ is a converging field.

In the above described optical system, ions generated in the ion source 1 and passed through the main slit 2 are directed toward the electrostatic field $E_1$ as ion beam having a directional dispersion $\alpha$ in the lateral direction (along the radius of curvature). The ion beam subjected to the concave lens action of the electrostatic field $E_1$ enters the electrostatic field $E_2$ connected without any gap with the field $E_1$ at a directional dispersion $\alpha'$ greater than the directional dispersion $\alpha$ (see FIGS. 1 and 2). As a result, the ion beam enters the electrostatic field $E_2$ in such a manner that the ion beam has been emitted from a virtual image point F. The image magnification at the virtual image point F becomes $\alpha/\alpha'$ and hence the image size is reduced. Although the beam width in the direction of the radius of curvature r becomes considerably large at the boundary between the fields $E_1$ and $E_2$, the aberration caused in the ion beam by passing through the boundary is of an extremely small amount because the intensities of the electrostatic fields $E_1$ and $E_2$ are equal between each other and both fields $E_1$ and $E_2$ are tightly connected together without any gap so as to minimize the disturbance in the boundary field between the electrostatic fields $E_1$ and $E_2$.

The ion beam thus entered the field $E_2$ obtaining very little aberrations reducing its width under the convex lens action of the electrostatic field $E_2$ and is converged at a point P adjacent to the exit boundary of the field $E_2$. Differing from the boundary between the fields $E_1$ and $E_2$, the exit boundary of the field $E_2$ is contiguous to a free space having no electrostatic field. Accordingly, the disturbance in electrostatic field abruptly increases with the distance from the central orbit of the ion beam in the direction of the radius of curvature r. However, the ion beam has an extremely reduced beam width at the exit boundary of the field $E_2$ under the convex lens action of the field $E_2$, therefore, the ion beam can pass through the exit boundary at a central part which has the minimum disturbance. For this reason, the ion beam receives no remarkable aberrations when it passes through the exit boundary of the field $E_2$.

The ion beam thus delivered from the electrostatic field $E_2$ without remarkable aberrations now enters the magnetic field 8 disposed to satisfy the double focusing condition in combination with the electrostatic fields $E_1$ and $E_2$. The double focusing condition is the condition, possible when both electrostatic and magnetic lenses are used together, wherein ions of the same mass to charge ratio are brought together notwithstanding certain angular divergence or the velocity divergence. By the magnetic field 8, the ion beam is converged and is focused at a position of the slit 9.

Figure 3:
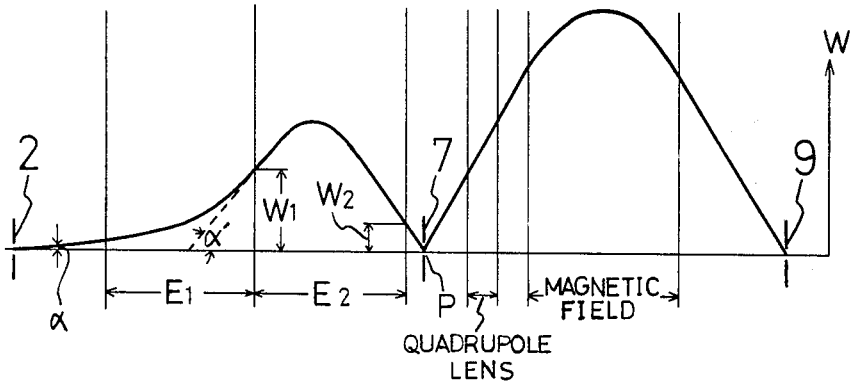
FIG. 3 is a diagram showing the width of an ion beam along the ion beam path.

FIG. 3 shows how the width W of the ion beam in the direction of the radius of curvature r varies along the ion path. It shows that the width W increases to $W_1$ at the boundary between the electrostatic fields $E_1$ and $E_2$, and decreases to $W_2$ at the exit boundary of the field $E_2$ and then to zero at the intermediate focus point P.

In the ion optical system of this invention, the occurrence of aberrations at the boundary between the electrostatic fields $E_1$ and $E_2$ and the exit boundary of the field $E_2$ can be substantially eliminated, it is possible to reduce the image magnification X smaller than $\frac{1}{4}$ by intensifying the concave lens action of the electrostatic field $E_1$ much more. As a result, the resolving power of the ion optical system can be improved in accordance with Eqn. (1). On the contrary, when the resolving power is held the sensitivity of the ion optical system can be improved by increasing the width S of the main slit 2.

Although FIG. 3 shows that the width of the ion beam increases at the entrance and exit ends of the magnetic field, the disadvantageous effects caused by spreading the width of the ion beam in the direction of the radius of curvature r are not serious because the disturbance of the field at the entrance and exit ends of the magnetic field does not occur in the direction of the radius of curvature r but mostly occurs in a direction perpendicular to the surface of the figure due to the fact that the surface of the magnetic poles for producing the magnetic field are extending in parallel with the surface of the figure. Furthermore, it is known that the second order aberrations caused by increasing the width of the ion beam in the direction of the radius of curvature r can be eliminated by providing an appropriate curvature on the end surfaces of the magnetic poles.

TABLE 1

| | a | b | c | d | e |
|---|---|---|---|---|---|
| $\phi$ m | 90° | 90° | 90° | 90° | 90° |
| re | 1.2 | 1.2 | 1.2 | 1.2 | 0.6 |
| $\phi$ e1 | 70° | 80° | 90° | 90° | 160° |
| C1 | 3.2 | 3.2 | 2.8 | 3.0 | 2.18 |
| C1′ | 6.144 | 4.096 | 9.408 | 3.6 | −3.802 |
| $\phi$ e2 | 80° | 85° | 90° | 90° | 110° |
| C2 | 0.04 | 0.05 | 0.15 | 0.03 | 1.0 |
| C2′ | 2.176 | 2.025 | 0.675 | 1.575 | −0.5 |
| QK | −1.64 | −1.61 | −1.85 | −1.6 | −1.6 |
| QL | 0.3 | 0.3 | 0.22 | 0.3 | 0.3 |
| R1 | −0.850 | −0.870 | −1.400 | −0.990 | −1.300 |
| R2 | 2.434 | 2.488 | 2.160 | 2.503 | 2.665 |
| L1 | 0.91 | 0.7 | 0.55 | 0.73 | 0.7 |
| L2 | 0.254 | 0.152 | 0.035 | −0.004 | 0.046 |
| L3 | 0.402 | 0.415 | 0.814 | 0.464 | 0.742 |
| L4 | 0.5 | 0.5 | 0.2 | 0.45 | 0.3 |

TABLE 1-continued

| | a | b | c | d | e |
|---|---|---|---|---|---|
| L5 | 0.980 | 0.969 | 1.185 | 0.994 | 1.036 |
| X | 0.123 | 0.110 | 0.133 | 0.099 | 0.097 |
| $\gamma$ | 0.990 | 0.985 | 1.092 | 0.997 | 1.018 |
| $\alpha^2$ | −0.009 | −0.043 | 0.010 | 0.068 | 0.123 |
| $\alpha\delta$ | 0.028 | 0.030 | −0.069 | −0.062 | −0.175 |
| $\delta^2$ | 0.018 | 0.012 | 0.079 | 0.061 | 0.444 |
| $\zeta^2$ | 0.029 | 0.036 | −0.022 | −0.142 | −0.550 |
| $\zeta\beta$ | 0.128 | 0.481 | 0.039 | 0.404 | 1.288 |
| $\beta^2$ | −0.386 | −0.296 | −0.226 | −0.304 | −1.812 |
| $\zeta$ | 1.386 | 1.371 | 1.549 | 1.323 | −1.326 |
| $\beta$ | 0.678 | 0.578 | 0.840 | 0.692 | 0.727 |

TABLE 2

| | f | g |
|---|---|---|
| $\phi$ m | 60° | 60° |
| re | 1.2 | 0.6 |
| $\phi$ e1 | 70° | 160° |
| C1 | 3.2 | 2.2 |
| C1' | −5.12 | −5.566 |
| $\phi$ e2 | 80° | 110° |
| C2 | 0.04 | 1.0 |
| C2' | 1.824 | −0.55 |
| QK | −1.48 | −1.4 |
| QL | 0.3 | 0.3 |
| R1 | −1.180 | −1.800 |
| R2 | 1.108 | 1.822 |
| L1 | 0.91 | 0.7 |
| L2 | 0.254 | 0.056 |
| L3 | 0.862 | 1.160 |
| L4 | 0.7 | 0.7 |
| L5 | 2.115 | 1.913 |
| X | 0.145 | 0.099 |
| $\gamma$ | 1.166 | 1.078 |
| $\alpha^2$ | −0.005 | 0.081 |
| $\alpha\delta$ | 0.050 | −0.059 |
| $\delta^2$ | 0.047 | 0.527 |
| $\zeta^2$ | 0.869 | −0.036 |
| $\zeta\beta$ | 0.646 | 0.880 |
| $\beta^2$ | −1.043 | −2.348 |
| $\zeta$ | 1.413 | −1.244 |
| $\beta$ | 0.663 | 1.041 |

In Tables 1 and 2, calculated values of the image magnification X, mass dispersion coefficient $\gamma$, and various aberration coefficients are shown for seven examples of the ion optical system. Calculations were done on the basis of the following parameters, viz., $\Phi_m$: the deflection angle of the converging magnetic field, $\Phi_{e1}$: the deflection angle of the diverging electric field, $\Phi_{e2}$: the deflection angle of the converging electric field, $C_1'$: the differential of $C_1$ at $r=r_e$, $(d\ C_1/d\ r)_{r=re}$, $C_2'$: the differential of $C_2$ at $r=r_e$, $(d\ C_2/d\ r)_{r=re}$, $Q_k$: the intensity of the quadrupole lens, $Q_L$: the length of the quadrupole lens, $R_1$: the radius of curvature at the entrance ends of the magnetic poles, $R_2$: the radius of curvature at the exit end of the magnetic poles, $L_1$: the distance between the slit 2 and the entrance end of the diverging electrostatic field $E_1$, $L_2$: the distance between the exit end of the converging electrostatic field $E_2$ and the intermediate focus point P, $L_3$: the distance between the focus point P and the entrance end of the quadrupole lens, $L_4$: the distance between the exit end of the guadrupole lens and the entrance end of the magnetic field, $L_5$: the distance between the exit end of the magnetic field and the collector slit 9.

Among these, $r_e$, $Q_L$, $R_1$, $R_2$, $L_1$–$L_5$ are normalized by the radius of curvature $r_m$ of the ion beam in the magnetic field.

In Table 1, the distance $L_2$ in the example d has a negative value, showing that the focus point P is within the electrostatic field $E_2$. It is important that the focus point is in a position adjacent to the exit end of the electrostatic field $E_2$ for the purpose of narrowing the width of the ion beam at this end.

Judging from Tables 1 and 2, it is apparent that where $\Phi_m=60°$ to 90°, $\Phi_{e1}=70°$ and 160°, and $\Phi_{e2}=80°$ to 110° all being in ordinarily considerable ranges, the image magnification X can be reduced into a range of from 0.133 to 0.097 (roughly from $\frac{1}{8}$ to 1/10), and various aberration coefficients can be maintained at extremely small values approximately equal to zero. As a result, according to the Eqn. (1) the resolving power R can be increased, or when the resolving power R is held at the same value, the sensitivity of the ion optical system can be improved by spreading the width of the collector slit.

Figure 4:
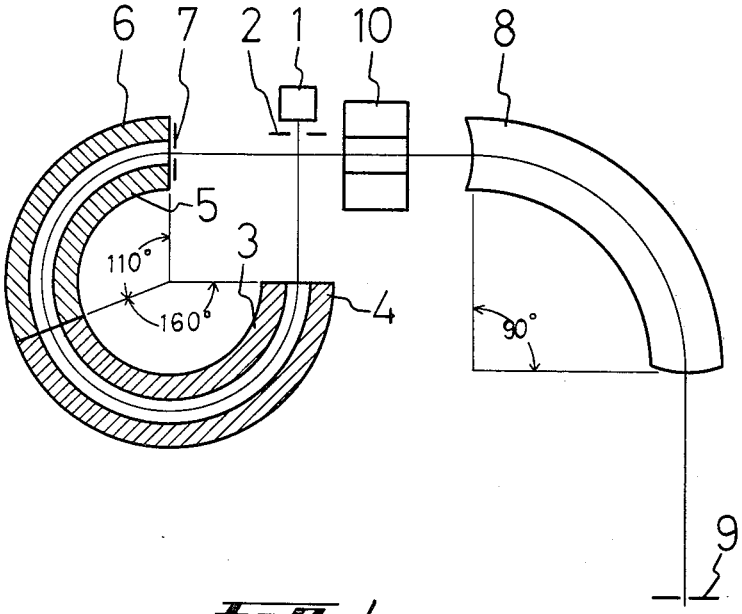
FIG. 4 is a diagram of another embodiment of the invention.

FIG. 4 shows an ion optical system corresponding to the example e in Table 1. In this example, the image magnification X is reduced to an extremely small value of 0.097. Although $\Phi_{e1}$ and $\Phi_{e2}$ are 160° and 110°, respectively, the radius of curvature $r_e$ can be reduced to 0.6, therefore the size of the electrostatic fields can be substantially diminished.

In the embodiments shown in FIGS. 1 and 4, the inner electrodes as well as the outer electrodes are brought into tight contact and electrically connected with each other so as to form two kinds of electrostatic fields utilizing single electric power source. However, the present invention is not necessarily restricted to such a construction. For example, the two kinds of electrostatic fields are not necessarily brought into tight contact, the presence of a slight gap is permitted so far as the gap does not provide a substantial free space between the two electrostatic fields.

Having thus described the invention with the detail and particularity required by the Patent Laws, what is desired protected by Letters Patent is set forth in the following claims.

I claim:

1. A double focusing mass spectrometer comprising:

an ion source for producing an ion beam;

first inner and outer electrodes for producing a diverging electrostatic field so as to diverge the ions emitted from said source;

second inner and outer electrodes for producing a converging electrostatic field so as to converge the ions delivered from said diverging electrostatic field at an intermediate focus point;

means for producing a converging magnetic field so as to re-converge the ions once converged at said intermediate focus point by said converging electrostatic field; and means for detecting the ions converged by the magnetic field;

such that said two electrostatic fields are connected with each other without substantial free space therebetween, and that said intermediate focus point of the ion beam is formed at a position adjacent to the ion exit boundary of said converging electrostatic field.

2. The double focusing mass spectrometer of claim 1 wherein the first and second inner electrodes are electrically connected with each other, and the first and second outer electrodes are electrically connected with each other.

3. The double focusing mass spectrometer of claim 1 wherein the radii of curvature of the central orbits of the ions in said two electrostatic fields are equal.

4. The double focusing mass spectrometer of claim 1, 2 or 3 further comprising a quadrupole lens means disposed between said intermediate focus point and said converging magnetic field for converging the ion beam in the Z direction.

5. A mass spectrometer comprising:

an ion source for producing an ion beam;

means for producing a diverging electrostatic field so as to diverge the ions emitted from said source;

means for producing a converging electrostatic field so as to converge the ions delivered from said diverging electrostatic field at an intermediate focus point;

means for producing a converging magnetic field so as to re-converge the ions once converged at said intermediate focus point and to satisfy the double focusing condition in combination with said means for producing electrostatic fields; and means for detecting the ions converged by the magnetic field;

such that said two electrostatic fields are connected with each other without substantial free space therebetween, and that said intermediate focus point of the ion beam is formed at a position adjacent to the ion exit boundary of said converging electrostatic field.

6. The double focusing mass spectrometer of claim 5 wherein the radii of curvature of the central orbits of the ions in said two electrostatic fields are equal.

7. The double focusing mass spectrometer of claim 5 or 6 further comprising a quadrupole lens means disposed between said intermediate focus point and said converging magnetic field.

* * * * *